US009304459B2

(12) United States Patent
Suzuki

(10) Patent No.: US 9,304,459 B2
(45) **Date of Patent: *Apr. 5, 2016**

(54) FIXING DEVICE HAVING STABLY POSITIONED NIP PLATE

(71) Applicant: Brother Kogyo Kabushiki Kaisha, Nagoya-shi, Aichi-ken (JP)

(72) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/593,350

(22) Filed: Jan. 9, 2015

(65) Prior Publication Data

US 2015/0125194 A1 May 7, 2015

Related U.S. Application Data

(63) Continuation of application No. 13/426,656, filed on Mar. 22, 2012, now Pat. No. 8,948,671.

(30) Foreign Application Priority Data

Apr. 28, 2011 (JP) ..... 2011-102095

(51) Int. Cl.
*G03G 15/20* (2006.01)

(52) U.S. Cl.
CPC ..... *G03G 15/2053* (2013.01); *G03G 15/2025* (2013.01); *G03G 2215/2035* (2013.01)

(58) Field of Classification Search
CPC ..... G03G 2215/2035
USPC ..... 399/329
See application file for complete search history.

(56) References Cited

U.S. PATENT DOCUMENTS 5,278,618 A 1/1994 Mitani et al.
7,027,763 B2 4/2006 Kato et al.

(Continued)

FOREIGN PATENT DOCUMENTS

JP H08-248791 A 9/1966
JP H04-44074 A 2/1992

(Continued)

OTHER PUBLICATIONS

Feb. 17, 2015—(JP) Office Action—App 2011-102095, Eng Tran.

(Continued)

*Primary Examiner* — David Gray
*Assistant Examiner* — Tyler Hardman
(74) *Attorney, Agent, or Firm* — Banner & Witcoff, Ltd.

(57) ABSTRACT

A fixing device for thermally fixing a developing agent image to a sheet includes: a flexible tubular member defining an axis extending in an axial direction; a heater; a nip plate configured to be in sliding contact with the tubular member and having an engaging portion; a backup member configured to nip the flexible tubular member in cooperation with the nip plate; and a stay configured to support the nip plate and having an end portion in the axial direction. The stay includes: a support portion configured to support the nip plate; a plurality of hook portions provided at the end portion to support the nip plate; and a protruding portion protruding toward the backup member and configured to engage the engaging portion such that the nip plate is restricted from moving in a direction orthogonal to a direction in which the backup member confronts the nip plate.

21 Claims, 7 Drawing Sheets

(56) References Cited

U.S. PATENT DOCUMENTS

| | | | | |
|---|---|---|---|---|
| 7,235,761 | B1 | 6/2007 | Maul et al. | |
| 7,386,265 | B2 | 6/2008 | Ito et al. | |
| 7,406,286 | B2 | 7/2008 | Yoshioka et al. | |
| 7,437,110 | B2 | 10/2008 | Kondo et al. | |
| 7,890,040 | B2 | 2/2011 | Lee et al. | |
| 7,986,909 | B2 | 7/2011 | Nanba | |
| 8,032,069 | B2 | 10/2011 | Shin et al. | |
| 8,121,528 | B2 | 2/2012 | Pawlik et al. | |
| 8,606,135 | B2 | 12/2013 | Yamashina et al. | |
| 8,750,775 | B2 | 6/2014 | Ishida et al. | |
| 8,948,671 | B2 * | 2/2015 | Suzuki | 399/329 |
| 2004/0151522 | A1 | 8/2004 | Kato et al. | |
| 2010/0266319 | A1 | 10/2010 | Matsuoka et al. | |
| 2010/0290822 | A1 | 11/2010 | Hasegawa et al. | |
| 2011/0150543 | A1 * | 6/2011 | Fujiwara et al. | 399/328 |
| 2011/0158715 | A1 | 6/2011 | Suzuki et al. | |
| 2011/0158716 | A1 | 6/2011 | Fujiwara et al. | |
| 2011/0170920 | A1 | 7/2011 | Fujiwara et al. | |
| 2012/0163889 | A1 * | 6/2012 | Koyama | 399/339 |
| 2012/0170957 | A1 | 7/2012 | Lim et al. | |
| 2012/0251138 | A1 | 10/2012 | Ishida et al. | |
| 2012/0251207 | A1 | 10/2012 | Ishida et al. | |
| 2012/0275831 | A1 | 11/2012 | Ishida et al. | |
| 2013/0071157 | A1 | 3/2013 | Suzuki et al. | |

FOREIGN PATENT DOCUMENTS

| | | | | |
|---|---|---|---|---|
| JP | 07271165 | A | * | 10/1995 |
| JP | H07-271165 | A | | 10/1995 |
| JP | H07-287461 | A | | 10/1995 |
| JP | 2003-223064 | A | | 8/2003 |
| JP | 2003-295671 | A | | 10/2003 |
| JP | 2004-184814 | A | | 7/2004 |
| JP | 2004286933 | A | | 10/2004 |
| JP | 2005-114959 | A | | 4/2005 |
| JP | 2005242113 | A | | 9/2005 |
| JP | 2006-047769 | A | | 2/2006 |
| JP | 2009-288284 | A | | 12/2009 |
| JP | 2010-009781 | A | | 1/2010 |
| JP | 2010-230774 | A | | 10/2010 |
| JP | 2010-286815 | A | | 12/2010 |
| JP | 2010282237 | A | | 12/2010 |
| JP | 2011033654 | A | | 2/2011 |
| JP | 2011-095549 | A | | 5/2011 |
| JP | 2011-095550 | A | | 5/2011 |
| JP | 2011-137933 | A | | 7/2011 |

OTHER PUBLICATIONS

Non-Final Office Action mailed Aug. 27, 2013, U.S. Appl. No. 13/426,648.

Co-pending U.S. Appl. No. 13/426,662, filed Mar. 22, 2012.

Co-pending U.S. Appl. No. 13/426,653, filed Mar. 22, 2012.

Co-pending U.S. Appl. No. 13/426,648, filed Mar. 22, 2012.

Non-Final Office Action received in U.S. Appl. No. 13/426,662 mailed Oct. 23, 2013.

Notice of Allowance issued in U.S. Appl. No. 13/426,653 mailed Jan. 30, 2014.

Notice of Allowance issued in corresponding U.S. Appl. No. 13/426,662 mailed Jul. 9, 2014.

Sep. 15, 2015—(JP) Decision of Rejection—App 2011-102095, Eng Tran.

* cited by examiner

FIXING DEVICE HAVING STABLY POSITIONED NIP PLATE

CROSS REFERENCE TO RELATED APPLICATION

This application is a continuation application of U.S. patent application Ser. No. 13/426,656 filed Mar. 22, 2012 which claims priority from Japanese Patent Application No. 2011-102095 filed Apr. 28, 2011. The entire contents of the above noted application are incorporated herein by reference.

TECHNICAL FIELD

The present invention relates to a fixing device that thermally fixes a transferred developing agent image to a sheet.

BACKGROUND

A conventional thermal fixing device includes an endless fixing (fusing) belt, a nip plate that slidingly contacts an inner peripheral surface of the fixing belt, a backup roller that is pressed toward the nip plate via the fixing belt, a guide member that supports the nip plate, and a stay that supports the guide member. In this fixing device, the stay is disposed at a side opposite to the back-up roller with respect to the nip plate such that the stay receives, via the guide member, a pressing force applied from the back-up member to the nip plate.

SUMMARY

In the above-described construction, the nip plate needs to be maintained at a prescribed position during assembly of the fixing device as well as during operation of the fixing device.

In view of the foregoing, it is an object of the present invention to provide a fixing device capable of preventing a nip plate from moving from its prescribed position.

In order to attain the above and other objects, there is provided a fixing device for thermally fixing a developing agent image to a sheet. The fixing device includes a flexible tubular member; a heater; a nip plate; a backup member; and a stay. The flexible tubular member has an inner peripheral surface defining an internal space, the flexible tubular member defining an axis extending in an axial direction. The heater is disposed at the internal space. The nip plate is disposed at the internal space and has a first surface configured to be in sliding contact with the inner peripheral surface of the flexible tubular member and a second surface opposite to the first surface, the nip plate being formed with an engaging portion. The backup member is configured to nip the flexible tubular member in cooperation with the first surface of the nip plate, the backup member confronting the first surface of the nip plate in a first direction. The stay extends in the axial direction and is configured to cover the heater and support the nip plate, the stay providing an opening facing toward the nip plate and having an end portion in the axial direction. The stay includes: a support portion configured to support the second surface of the nip plate; a plurality of hook portions provided at the end portion and configured to support the first surface of the nip plate; and a protruding portion protruding in the first direction toward the backup member and configured to engage the engaging portion such that the nip plate is restricted from moving in a direction orthogonal to the first direction.

According to another aspect of the present invention, there is provided a fixing device for thermally fixing a developing agent image to a sheet. The fixing device includes a flexible tubular member; a heater; a nip plate; a backup member; and a stay. The flexible tubular member has an inner peripheral surface defining an internal space, the flexible tubular member defining an axis extending in an axial direction. The heater is disposed at the internal space. The nip plate is disposed at the internal space and has a first surface configured to be in sliding contact with the inner peripheral surface of the flexible tubular member and a second surface opposite to the first surface, the nip plate being formed with an engaging portion. The backup member is configured to nip the flexible tubular member in cooperation with the first surface of the nip plate, the backup member confronting the first surface of the nip plate in a first direction. The stay extends in the axial direction and is configured to cover the heater and support the nip plate, the stay providing an opening facing toward the nip plate and having an end portion in the axial direction. The stay includes: a support portion configured to support the second surface of the nip plate; a plurality of hook portions provided at the end portion and configured to support the first surface of the nip plate; and an engaged portion disposed at the end portion and orienting toward the backup member to be engaged with the engaging portion in the first direction such that the nip plate is restricted from moving in a direction orthogonal to the first direction.

DETAILED DESCRIPTION

First, a general configuration of a laser printer 1 incorporating a fixing device 100 according to an embodiment of the present invention will be described with reference to FIG. 1. In the following description, a general structure of the laser printer 1 will be described first and a detailed structure of the fixing device 100 will be then described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
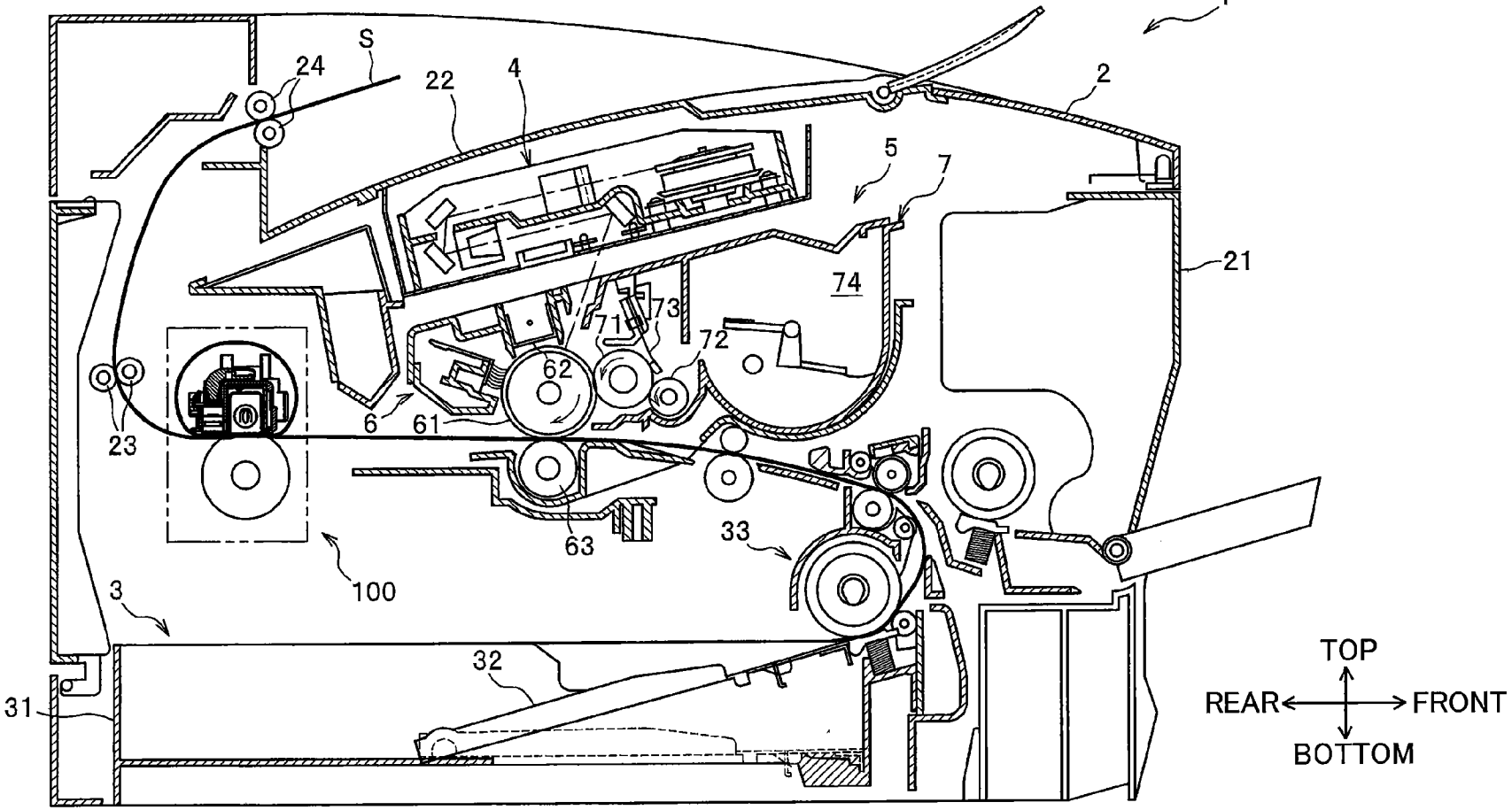
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S, a sheet conveying mechanism 33. Each sheet S accommodated in the sheet supply tray 31 is lifted upward by the lifter plate 32, and is conveyed toward the process cartridge 5 by the sheet conveying mechanism 33.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data such that a surface of a photosensitive drum 61 (described later) is exposed by high speed scanning of the laser beam.

The process cartridge 5 is disposed below the exposure unit 4. The process cartridge 5 is detachably loadable in the main frame 2 through an opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to the high speed scanning of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61, thereby developing the electrostatic latent image into a visible toner image. The toner image is thus formed on the surface of the photosensitive drum 61. Subsequently, when the sheet S is conveyed between the photosensitive drum 61 and the transfer roller 63, the toner image formed on the photosensitive drum 61 is transferred onto the sheet S.

The fixing device 100 is disposed rearward of the process cartridge 5. The toner image (toner) transferred onto the sheet S is thermally fixed on the sheet S while the sheet S passes through the fixing device 100. The sheet S on which the toner image has been thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 6B.

Figure 2:
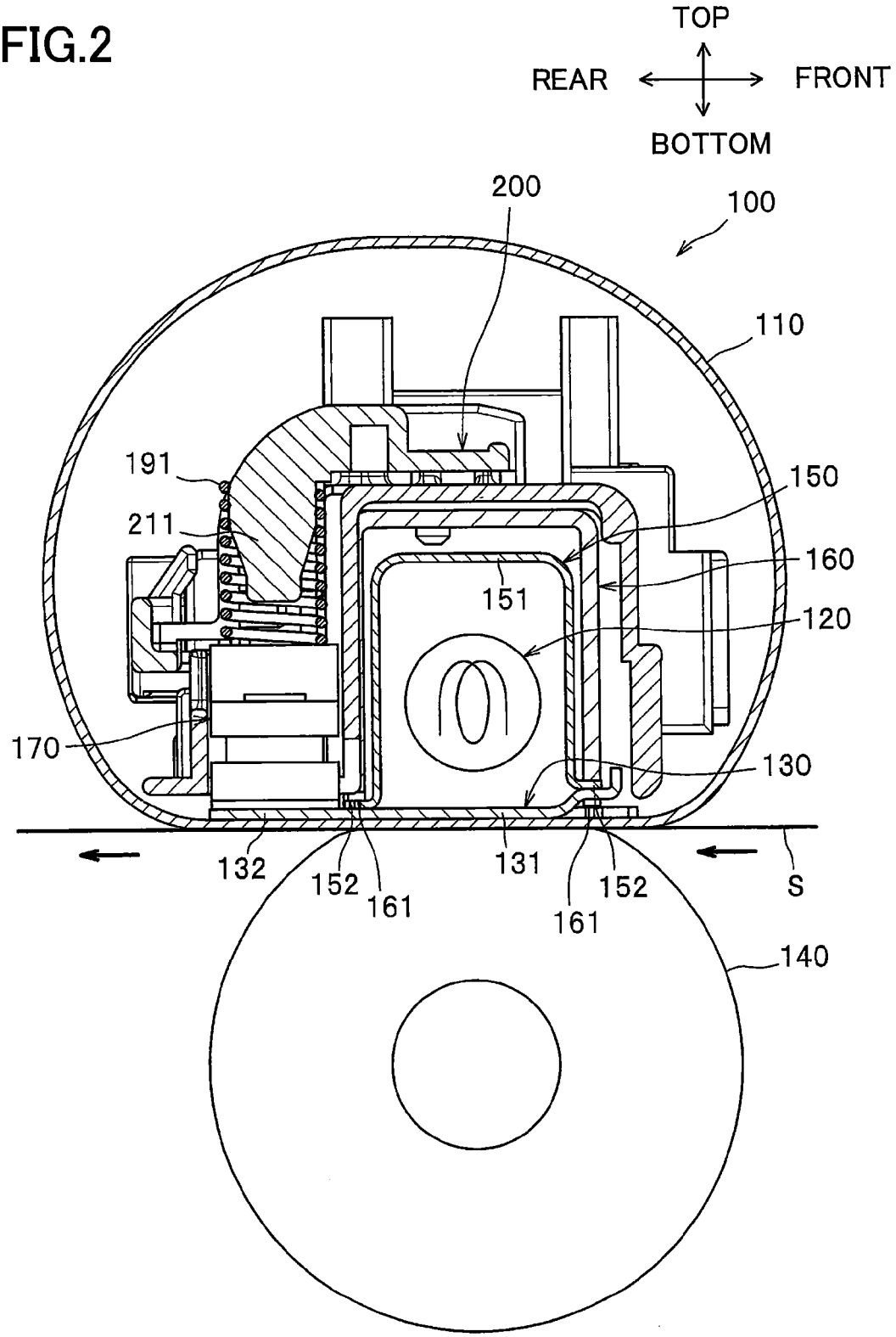
FIG. 2 is a schematic cross-sectional view of the fixing device according to the embodiment taken along a plane in which a thermostat of the fixing device is included.

As shown in FIG. 2, the fixing device 100 includes a flexible fusing belt 110 as a tubular member, a halogen lamp 120 as a heater, a nip plate 130, a backup roller 140 as a backup member, a reflection member 150, a stay 160, a thermostat 170, two thermistors 180 (see FIG. 3), coil springs 191 and 192 (see FIG. 3) and a support member 200.

In the following description, a direction in which the sheet S is conveyed (a front-to-rear direction) will be simply referred to as a sheet conveying direction, wherever appropriate.

The fusing belt 110 is of an endless belt (of a tubular configuration) having heat resistivity and flexibility. The fusing belt 110 has an internal space within which the halogen lamp 120, the nip plate 130, the reflection member 150, the stay 160 and the support member 200 are disposed. The fusing belt 110 has widthwise end portions that are guided by guide members (not shown) so that the fusing belt 110 is circularly movable. The fusing belt 110 extends in a direction coincident with the left-to-right direction (see FIG. 5B). Hereinafter, the direction in which the fusing belt 110 extends will be referred to as an axial direction of the fusing belt 110, wherever necessary.

The halogen lamp 120 is a heater to generate radiant heat to heat the nip plate 130 and the fusing belt 110 for heating toner on the sheet S. The halogen lamp 120 is positioned at the internal space of the fusing belt 110 such that the halogen lamp 120 is spaced away from an inner surface of the nip plate 130 by a predetermined distance.

The nip plate 130 has a plate-like shape and is adapted to receive radiant heat from the halogen lamp 120. To this effect, the nip plate 130 is positioned within the internal space of the fusing belt 110 such that an inner peripheral surface of the fusing belt 110 is slidably movable with a lower surface of the nip plate 130. The nip plate 130 is made from a resiliently deformable metal. In the embodiment, the nip plate 130 is made of aluminum having a thermal conductivity higher than that of the stay 160 (described later) made from steel. For fabricating the nip plate 130, an aluminum plate is bent to provide a base portion 131, a first protruding portion 132, two second protruding portions 133, a first retained portion 134, a second retained portion 135, and an opening 136, as shown in FIG. 3.

The base portion 131 is flat and extends in the left-to-right direction. The base portion 131 has a lower surface that is in sliding contact with the inner peripheral surface of the fusing belt 110. The base portion 131 transmits the radiant heat from the halogen lamp 120 to the toner on the sheet S via the fusing belt 110.

Figure 3:
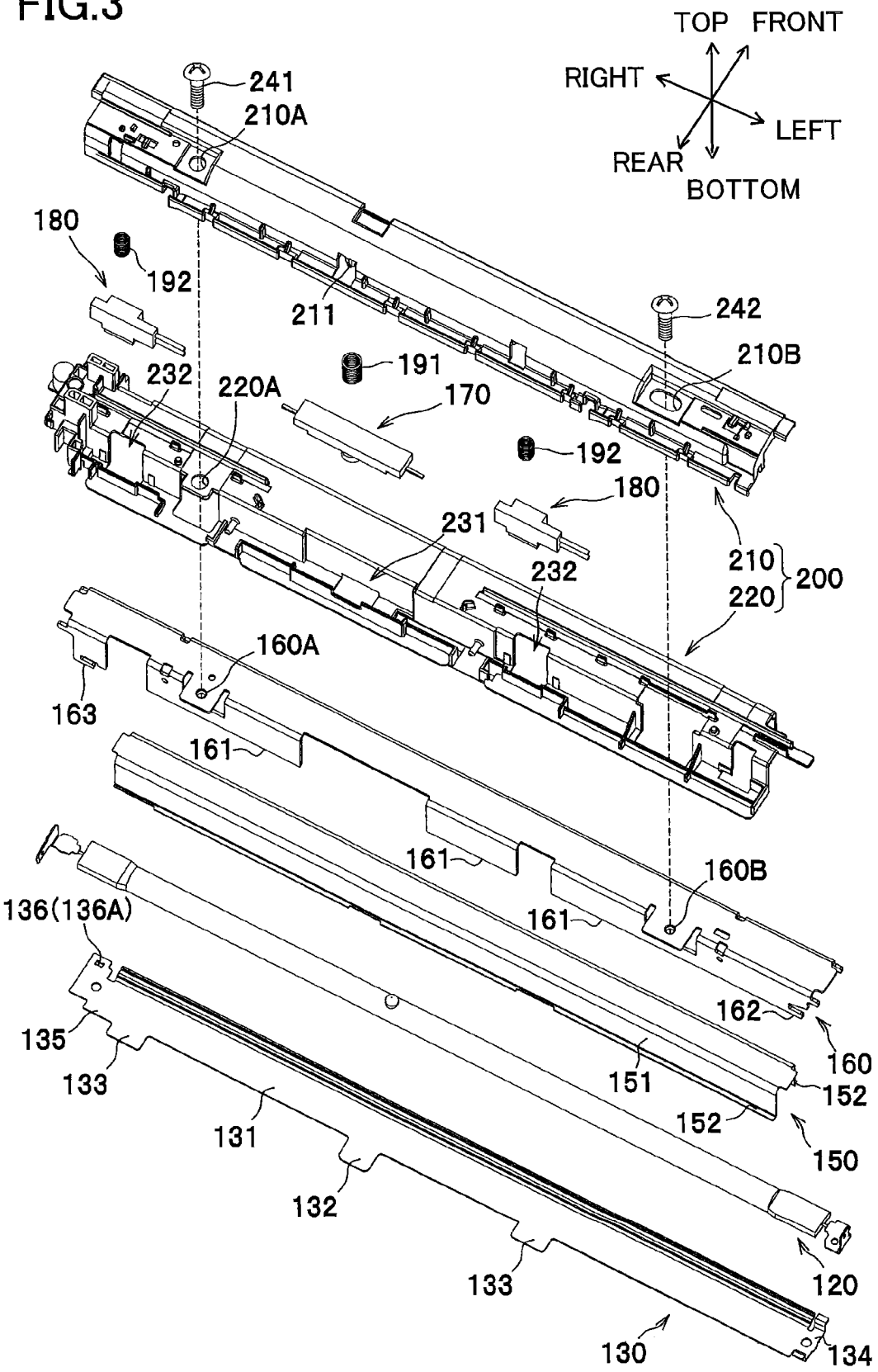
FIG. 3 is an exploded perspective view of the fixing device according to the embodiment, the fixing device including a halogen lamp, a nip plate, a reflection member, a stay, the thermostat, thermistors, coil springs, and support members.

Referring to FIG. 3, the base portion 131 has a rear end portion from which the first protruding portion 132 and the two second protruding portions 133 protrude rearward (toward downstream in the sheet conveying direction) respectively. Each of the first protruding portion 132 and the second protruding portions 133 has a substantially flat plate-like shape.

The first protruding portion 132 is formed on the rear end portion of the base portion 131 at a position adjacent to a lateral center of the rear end portion of the base portion 131 in the left-to-right direction. The first protruding portion 132 has an upper surface on which the thermostat 170 is disposed to confront the same.

The two second protruding portions 133 are formed on the rear end portion of the base portion 131 such that one of the second protruding portions 133 is arranged at a position adjacent to a right end portion of the rear end portion, while the other second protruding portion 133 is arranged at a position adjacent to the lateral center of the rear end portion but leftward of the first protruding portion 132 in the left-to-right direction. Each second protruding portion 133 has an upper surface on which one of the two thermistors 180 is disposed to face the same.

Figures 5A, 5B:
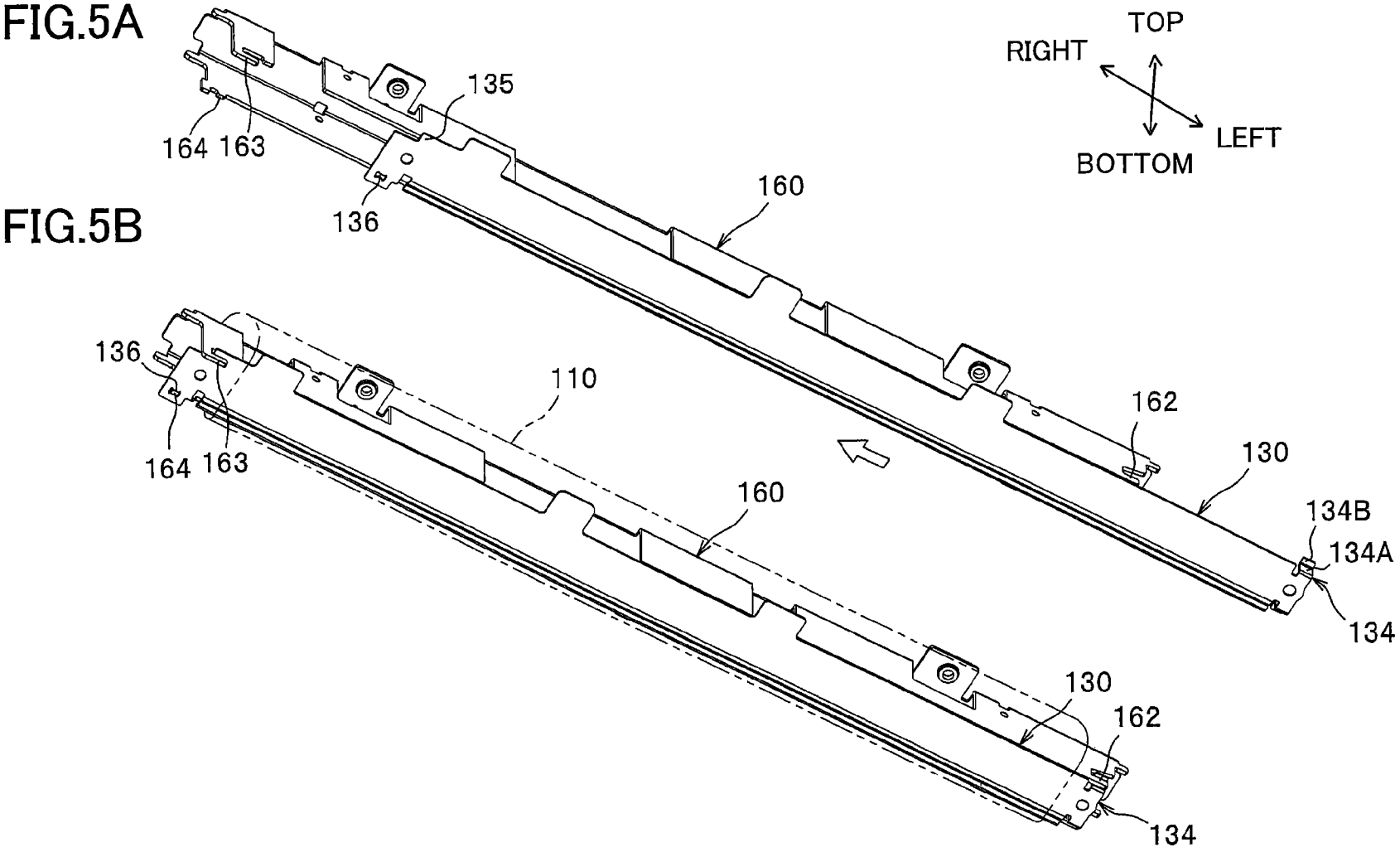
FIG. 5A is a view explaining assembly of the nip plate to the stay, wherein the nip plate is being assembled to the stay.
FIG. 5B is a view explaining assembly of the nip plate to the stay, wherein the nip plate has been assembled to the stay.

The first retained portion 134 is formed at a left end portion of the nip plate 130. As shown in FIG. 5B, the nip plate 130 has a length longer than that of the fusing belt 110 in the left-to-right direction. In other words, the nip plate 130 (its lower surface) is in sliding contact with the fusing belt 110 (more specifically, the inner peripheral surface of the fusing belt 110) within a range indicated by a double-dot chain line in FIG. 5B. The first retained portion 134 is positioned outside of this range such that the first retained portion 134 can be engaged with a first hook portion 162 (described later) of the stay 160 when the nip plate 130 is assembled to the stay 160.

Figure 4:
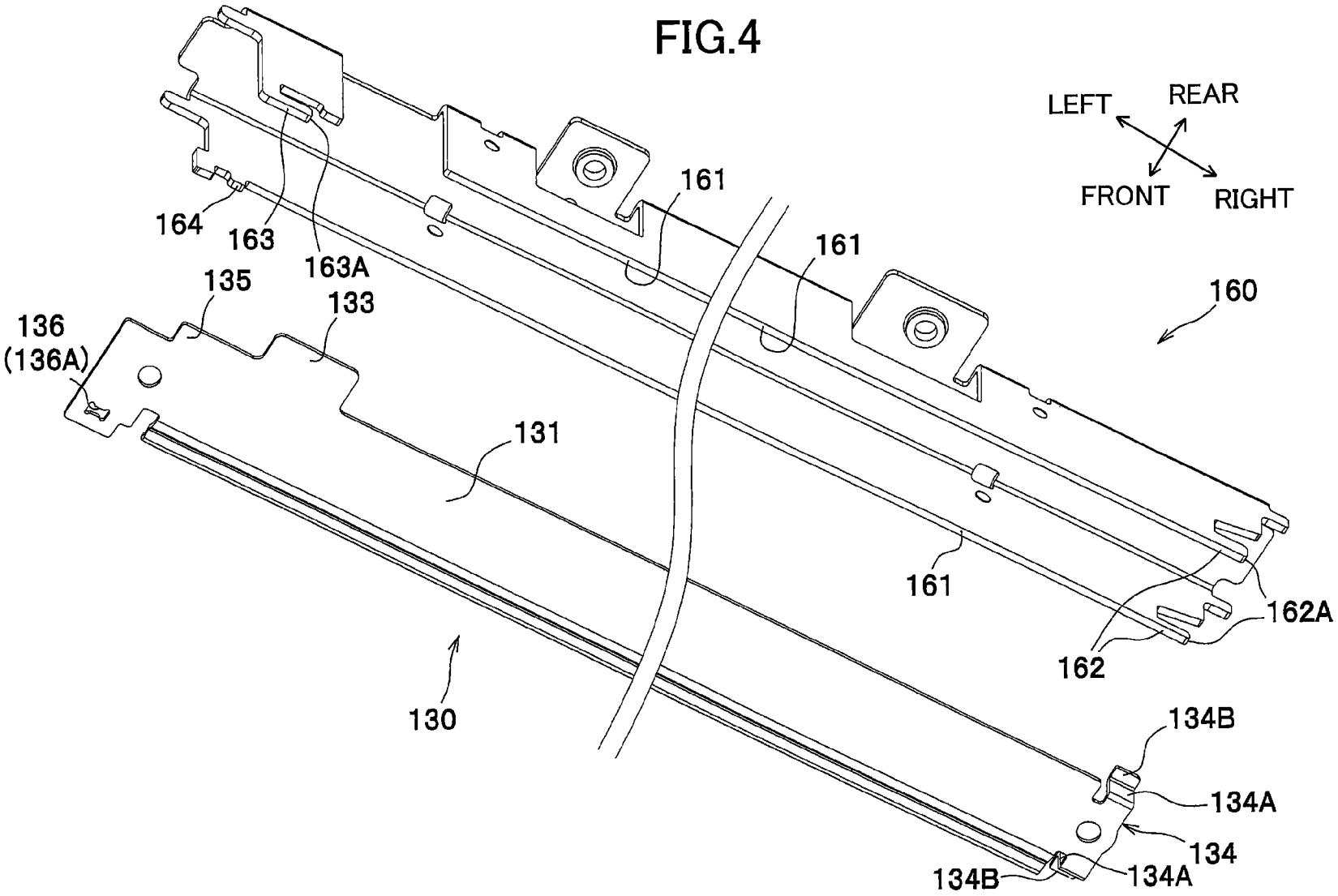
FIG. 4 is a perspective view of the nip plate and the stay as viewed from below.

As shown in FIGS. 3 and 4, the first retained portion 134 has a substantially U-shaped configuration as viewed from a left side including a pair of side wall sections 134A and a pair of engaged sections 134B. The pair of side wall sections 134A opposes each other in the front-to-rear direction and each side wall section 134A extends upward. Each engaged section 134B extends horizontally (frontward or rearward) from an upper end portion of each side wall section 134A.

The nip plate 130 has a right end portion on which the second retained portion 135 is formed. Specifically, the second retained portion 135 is formed at a rear end portion of the right end portion of the nip plate 130 so as to be positioned outside of the range within which the nip plate 130 slidingly contacts the fusing belt 110. The second retained portion 135 is engageable with a second hook portion 163 (described later) of the stay 160.

The right end portion of the nip plate 130 has a front end portion on which the opening 136 is formed to penetrate therethrough (i.e., a through-hole). The opening 136 has a periphery 136A serving as an engaging portion that is engageable with a protruding portion 164 (described later) of the stay 160. More specifically, the opening 136 is formed at a side (front side) opposite to that (rear side) on which the first and second protruding portions 132, 133 are formed in the sheet conveying direction, and at a position rightward of the second retained portion 135 in the left-to-right direction. The opening 136 has a dimension slightly greater than that of the protruding portion 164 so that the opening 136 can be easily coupled to the protruding portion 164.

The backup roller 140 is disposed below the nip plate 130 such that the backup roller 140 nips the fusing belt 110 in cooperation with the nip plate 130, as shown in FIG. 2. In the present embodiment, the nip plate 130 and the backup roller 140 are biased toward each other so as to be in pressure contact with each other. When the sheet S is jammed between the nip plate 130 and the backup roller 140, either one of the nip plate 130 and the backup roller 140 can be moved so as to be separated from the other.

The backup roller 140 is configured to rotate upon receipt of a driving force transmitted from a motor (not shown) disposed within the main frame 2. As the backup roller 140 rotates, the fusing belt 110 is circularly moved along the nip plate 130 because of a friction force generated between the back-up roller 140 and the fusing belt 110 or between the sheet S and the fusing belt 110. The toner image on the sheet S can be thermally fixed thereto by heat and pressure during passage of the sheet S between the backup roller 140 and the fusing belt 110.

The reflection member 150 is adapted to reflect radiant heat from the halogen lamp 120 (radiant heat radiated mainly upward, downward, frontward and rearward) toward the nip plate 130. As shown in FIG. 2, the reflection member 150 is positioned at the internal space of fusing belt 110 and surrounds the halogen lamp 120 with a predetermined distance therefrom. Thus, heat from the halogen lamp 120 can be efficiently concentrated onto the nip plate 130 to promptly heat the nip plate 130 and the fusing belt 110.

The reflection member 150 has a U-shaped cross-section and is made from a material such as aluminum having high reflection ratio regarding infrared ray and far infrared ray. Specifically, the reflection member 150 has a U-shaped reflection portion 151 and two flange portions 152 each extending from each end portion of the reflection portion 151 in the sheet conveying direction.

The stay 160 is adapted to support the nip plate 130 at the internal space of the fusing belt 110. The stay 160 has a U-shaped configuration in conformity with an outer profile of the reflection member 150 for covering the reflection member 150 and the halogen lamp 120. For fabricating the stay 160, a highly rigid member such as a steel plate is folded into U-shape that is open toward the nip plate 130. The stay 160 has an upper wall on which two fixing portions (shown without reference numerals) are formed. Specifically, the two fixing portions (right and left fixing portions) are formed at positions separated from each other in the left-to-right direction, and each fixing portion extends rearward from the upper wall of the stay 160. A screw hole 160A is formed on one of the fixing portions (the right fixing portion), while a screw hole 160B is formed at the other fixing portion (the left fixing portion). A screw 241 is screwed into the screw hole 160A, while a screw 242 is screwed into the screw hole 160B, as shown in FIG. 3. The support member 200 (described later) is thus fixed to the stay 160 by the screws 241, 242.

As shown in FIGS. 3 and 4, the stay 160 includes nip plate supporting portions 161, a pair of first hook portions 162, the second hook portion 163, and the protruding portion 164.

The stay 160 has front and rear walls opposing each other in the front-to-rear direction. Each of the front and rear walls has a lower surface (lower edge) serving as the nip plate supporting portion 161. The nip plate supporting portions 161 support the nip plate 130 via the flange portions 152 of the reflection member 150 for receiving load applied from the backup roller 140. More specifically, the nip plate supporting portions 161 are in abutment with an upper surface of the nip plate 130 (a surface opposite to the lower surface with which the fusing belt 110 slidingly contacts) such that the nip plate supporting portions 161 support front and rear end portions of the upper surface of the nip plate 130.

Here, the load applied from the backup roller 140 refers to a reaction force generated in response to a force with which the nip plate 130 biases the backup roller 140.

Each of the front and rear walls of the stay 160 also has a left end portion on which one of the pair of first hook portion 162 is formed. Referring to FIG. 5B, the first hook portions 162 are positioned outward of the range within which the nip plate 130 and the fusing belt 110 are in sliding contact with each other (the range indicated by the double-dot chain line in FIG. 5B). The first hook portions 162 are adapted to be engaged with the first retained portion 134 of the nip plate 130. Each first hook portion 162 extends leftward to provide a tip end orienting leftward.

The second hook portion 163 is formed at a right end portion of the rear wall of the stay 160. Referring to FIG. 5B, the second hook portion 163 is positioned outward of the range within which the nip plate 130 slidingly contacts the fusing belt 110. The second hook portion 163 has a substantially L-shape, protruding downward from a bottom end of the rear wall of the stay 160 and then extending leftward to have a tip end 163A.

In other words, the tip ends 162A of the first hook portions 162 and the tip end 163A of the second hook portion 163 all extend leftward in the axial direction (left-to-right direction). The stay 160 supports the nip plate 130 by the pair of first hook portions 162 and the second hook portion 163.

Figure 6A:
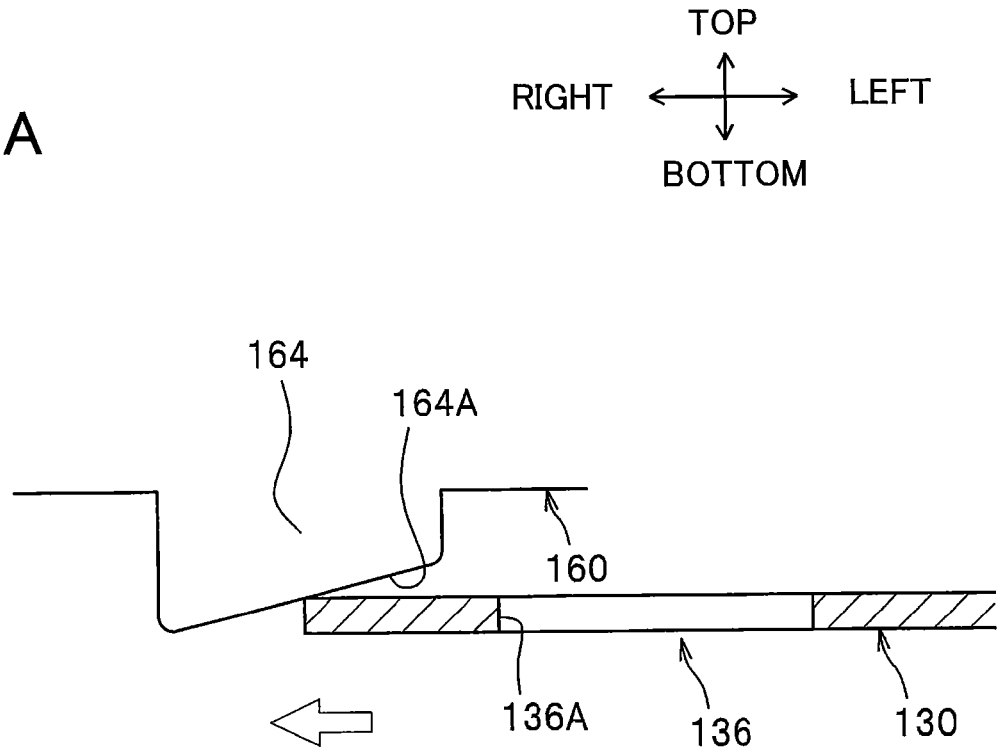
FIG. 6A is a partially-enlarged view of the stay and the nip plate, explaining how a protruding portion formed on the stay is engaged with an opening formed on the nip plate, wherein the opening is being moved rightward for engagement with the protrusion.
Figure 6B:
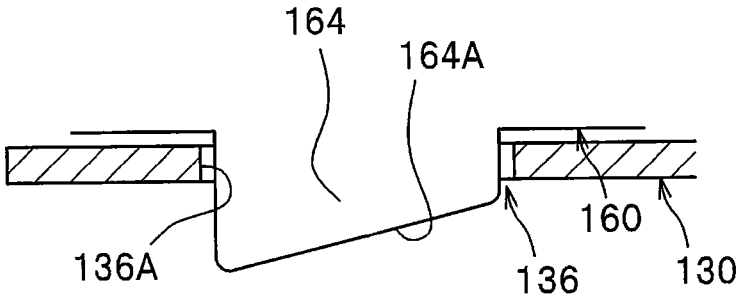
FIG. 6B is a partially-enlarged view of the stay and the nip plate, explaining how the protrusion is engaged with the opening, wherein the protrusion has been engaged with the opening.

The protruding portion 164 is formed at a right end portion of the front wall of the stay 160. The protruding portion 164 is positioned outward of the range within which the nip plate 130 and the fusing belt 110 are in sliding contact with each other (see FIG. 5B). Specifically, as shown in FIG. 4, the protruding portion 164 extends (protrudes) downward from a bottom end portion of the front wall of the stay 160. The protruding portion 164 is formed with a tip end 164A that slopes relative to the axial direction such that the tip end 164A approaches toward the nip plate supporting portion 161 (the lower surface of the front wall of the stay 160) as extending leftward, as shown in FIGS. 6A and 6B.

The thermostat 170 is a member configured to detect a temperature of the nip plate 130. The thermostat 170 is disposed at the internal space of the fusing belt 110 such that the thermostat 170 (more specifically, a lower surface of the thermostat 170) opposes the upper surface of the first protruding portion 132 of the nip plate 130. The lower surface of the thermostat 170 serves as a temperature detecting surface.

The thermostat 170 is coupled to a first positioning portion 231 formed on a second support member 220 (described later) so as to be positioned in the left-to-right direction as well as in the front-to-rear direction. The coil spring 191 is interposed between the thermostat 170 and the support member 200 so that the thermostat 170 can be biased toward the nip plate 130 (toward the first protruding portion 132). The thermostat 170 is thus stably positioned relative to the nip plate 130 and therefore the thermostat 170 can detect the temperature of the nip plate 130 with accuracy.

The two thermistors 180 are temperature sensors configured to detect the temperature of the nip plate 130. The thermistors 180 are disposed at the internal space of the fusing belt 110 such that a lower surface of each thermistor 180 opposes the upper surface of each second protruding portion 133 of the nip plate 130. The lower surface of each thermistor 180 serves as a temperature detecting surface.

Each thermistor 180 is coupled to each second positioning portion 232 (described later) of the second support member 220 so as to be positioned in the left-to-right direction as well as in the front-to-rear direction. One coil spring 192 is interposed between each thermistor 180 and the support member 200 such that the each thermistor 180 is biased toward the nip plate 130 (toward each second protruding portion 133). The thermistors 180 can be thus stably positioned relative to the nip plate 130, enabling the thermistors 180 to accurately detect the temperature of the nip plate 130.

When the thermostat 170 and the two thermistors 180 are mounted on the nip plate 130, due to biasing forces of the coil springs 191 and 192, the thermostat 170 and the thermistors 180 are biased (pressed) toward the first protruding portion 132 and the second protruding portions 133 of the nip plate 130 (i.e., toward a downstream side of the nip plate 130 in the sheet conveying direction) respectively. In other words, the protruding portion 164 of the stay 160 is positioned at a side (upstream side) opposite to that (downstream side) of the coil springs 191, 192 in the sheet conveying direction.

The support member 200 is disposed at the internal space of the fusing belt 110 so as to cover the stay 160, as shown in FIG. 2. The support member 200 may be formed of a liquid crystal polymer, a PEEK resin (polyether ether ketone resin), or a PPS resin (polyphenylene sulfide resin), for example.

The support member 200 includes a first support member 210 and the second support member 220, as shown in FIG. 3.

The first support member 210 is adapted to support the coil springs 191 and 192. The first support member 210 is substantially L-shaped in cross-section and extends in the left-to-right direction. The first support member 210 has an upper wall on which three spring supporting portions 211 are formed (only one of the spring supporting portions 211 is shown in FIG. 3). Each spring supporting portion 211 extends downward from a lower surface of the upper wall of the first support member 210 and receives one of the coil springs 191, 192. On the upper wall of the first support member 210, screw holes 210A, 210B are also formed such that the screws 241, 242 are screwed into the screw holes 210A, 210B respectively.

The second support member 220 serves to position the thermostat 170 and the thermistors 180. The second support member 220 has a substantially U-shaped cross-section and extends in the left-to-right direction. The second support member 220 has a rear wall on which the first positioning portion 231 for positioning the thermostat 170 and two second positioning portions 232 for positioning the two thermistors 180 are formed. The second support member 220 has an upper wall on which a through-hole 220A is formed for allowing the screw 241 to penetrate therethrough.

Next, how the nip plate 130 is assembled to the stay 160 will be described. In FIGS. 5A and 5B, the reflection member 150 and the halogen lamp 120 are omitted for simplifying explanation.

First, the reflection member 150 and the halogen lamp 120 are assembled to the stay 160. Then, as shown in FIG. 5A, the nip plate 130 is placed to confront the nip plate supporting portions 161 of the stay 160, and is then slid rightward along the nip plate supporting portions 161. As the nip plate 130 is slid, the engaged sections 134B of the first retained portion 134 are engaged with the first hook portions 162 of the stay 160, whereas the second retained portion 135 is engaged with the second hook portion 163 of the stay 160.

When the engaged sections 134B and the second retained portion 135 are respectively engaged with the first hook portions 162 and the second hook portion 163, the right end portion of the nip plate 130 abuts on the sloped tip end 164A of the protruding portion 164, as shown in FIG. 6A. At this time, the right end portion of the nip plate 130 is pulled rightward while being displaced downward, and is then pushed toward the stay 160. As described earlier, the nip plate 130 is made of a resiliently deformable metal, and the tip end 164A of the protruding portion 164 is sloped relative to the axial direction such that the tip end 164A approaches the nip plate supporting portion 161 (lower edge of the front wall of the stay 160) as extending leftward in the axial direction (i.e., the tip end 164A has a downstream end that is closer to the nip plate supporting portion 161 than an upstream end to the nip plate supporting portion 161 in a direction in which the stay nip plate 130 is slid). Hence, as shown in FIGS. 6A and 6B, the right end portion of the nip plate 130 can be slidingly moved rightward while being guided along the sloped tip end 164A. The right end portion of the nip plate 130 can therefore easily go rightward over the sloped tip end 164A of the protruding portion 164, such that the protruding portion 164 is coupled to the opening 136 (the periphery 136A of the opening 136), as shown in FIG. 6B.

The nip plate 130 is thus assembled to the stay 160, as shown in FIG. 5B. In this state, the upper surface of the nip plate 130 is supported by the nip plate supporting portions 161 of the stay 160, and the lower surface of the nip plate 130 is supported by the first hook portions 162 and the second hook portion 163 of the stay 160. The nip plate 130 is thus restricted from moving in a top-to-bottom direction (in a direction in which the nip plate 130 confronts the backup roller 140). Further, since the protruding portion 164 is coupled to the opening 136 (the protruding portion 164 is engaged with the periphery 136A of the opening 136), the nip plate 130 is also restricted from moving in the left-to-right direction as well as in the front-to-rear direction.

In other words, when assembled to the stay 160, the nip plate 130 is supported such that four corners of the nip plate 130 are respectively supported by the first hook portions 162, the second hook portion 163 and the protruding portion 164. Therefore, the nip plate 130 can be stably supported by the stay 160, compared to a case where only a central portion of the nip plate 130 is supported by the stay 160. Further, the first hook portions 162, the second hook portion 163 and the protruding portion 164 are all arranged outside of the range within which the fusing belt 110 is in sliding contact with the nip plate 130 in the left-to-right direction (see FIG. 5B). Therefore, the circular movement of the fusing belt 110 is never disturbed by the first hook portions 162, the second hook portion 163 and the protruding portion 164.

Further, when the sheet S is jammed between the nip plate 130 and the stay 160, either one of the nip plate 130 and the backup roller 140 is moved so as to be separated from the other to release pressure contact between the nip plate 130 and the backup roller 140. Referring to FIG. 2, when the pressure contact between the nip plate 130 and the backup roller 140 is released, the rear end portion of the nip plate 130 (downstream end in the sheet conveying direction) is applied with a force acting in a direction away from the stay 160 due to the biasing forces of the coil springs 191 and 192. At the same time, since the rear end portion of the nip plate 130 is pressed by the coil springs 191 and 192, the front end portion of the nip plate 130 (upstream end in the sheet conveying direction) is applied with a force acting in a direction toward the stay 160, which is a direction in which the opening 136 is urged to be coupled to the protruding portion 164. The nip plate 130 is therefore suppressed from moving both in the left-to-right direction and in the front-to-rear direction.

The stay 160 to which the nip plate 130 has been assembled is then fixed to the first support member 210 and the second support member 220 by the screws 241 and 242. When the first support member 210 and the second support member 220 are fixed to the stay 160, the thermostat 170, the thermistors 180 and the coil springs 191, 192 are also assembled to the first support member 210 and the second support member 220. The stay 160, the nip plate 130, the support member 200 (the first support member 210 and the second support member 220), the thermostat 170, the thermistors 180 and the coil springs 191, 192 assembled to one another constitute a heater unit. The assembled heater unit (the nip plate 130) and the backup roller 140 are then assembled to each other such that the heater unit and the backup roller 140 are biased toward each other so as to be in pressure contact with each other.

As described above, the nip plate 130 assembled to the stay 160 is restricted from moving in the top-to-bottom direction due to the engagement with the nip plate supporting portion 161, the first hook portions 162 and the second hook portion 163, and in the left-to-right direction and in the front-to-rear direction due to the engagement between the opening 136 (the periphery 136A) and the protruding portion 164. With this construction, even if the nip plate 130 and the backup roller 140 are separated from each other when a paper jam occurs at the fixing device 100, positioning of the nip plate 130 tends to be maintained.

Further, due to the engagement between the nip plate 130 and the stay 160, although the nip plate 130 assembled to the stay 160 (the heater unit) is separated from the backup roller 140 during assembly of the fixing device 100, the nip plate 130 is hard to move relative to the stay 160.

Further, the tip ends 162A of the first hook portions 162 and the tip end 163A of the second hook portion 163 all extend leftward. Therefore, the nip plate 130 is easily assembled to the stay 160 by simply sliding the nip plate 130 rightward from leftward in the axial direction. Further, with this construction, even when thermal expansion occurs at the nip plate 130, the thermal expansion can be released leftward.

Also, the protruding portion 164 is formed at one side (right side) of the nip plate 130 which is opposite to the other side (left side) to which the tip end 162A of each first hook portion 162 and the tip end 163A of the second hook portion 163 are oriented in the axial direction. Therefore, engagement between the protruding portion 164 and the opening 136 does not hinder release of the thermal expansion at the nip plate 130.

Further, the protruding portion 164 has the tip end 164A that is slanted relative to the axial direction such that the tip end 164A approaches the nip plate supporting portion 161 as extends leftward in the axial direction. Therefore, at the time of assembly of the nip plate 130 to the stay 160, the right end portion of the nip plate 130 can easily go over the protruding portion 164 as slidingly moves rightward along the slanted tip end 164A, so that the periphery 136A of the opening 136 can be engaged with the protruding portion 164. Assembly of the nip plate 130 to the stay 160 is thus facilitated.

Further, since the rear end portion of the nip plate 130 is biased toward the backup roller 140 due to the coil springs 191 and 192, the front end portion of the nip plate 130 is urged toward the stay 160. In other words, the opening 136 formed on the front end portion of the nip plate 130 is urged to be coupled to the protruding portion 164 of the stay 160. With this construction, the nip plate 130 can be held to the stay 160 reliably and stably.

Various modifications are conceivable.

For example, the opening 136 according to the embodiment formed on the nip plate 130 is a through-hole penetrating through the nip plate 130 in the top-to-bottom direction. However, the opening 136 may be a shape having a bottom portion and being open toward the protruding portion 164.

Figure 7:
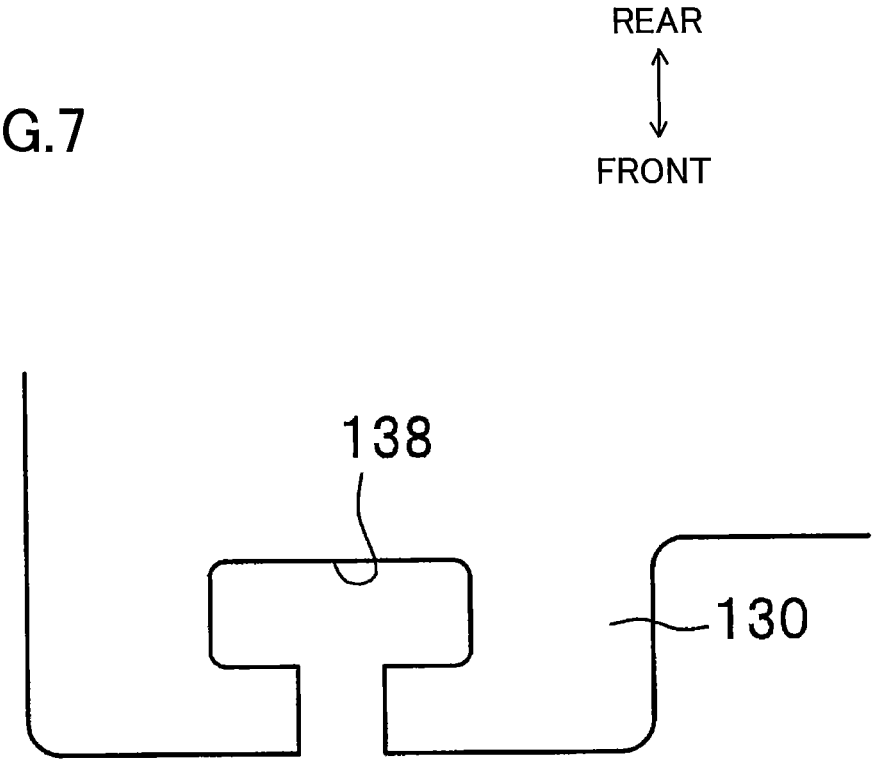
FIG. 7 is a partially-enlarged plan view of an opening according to a variation of the present embodiment.

FIG. 7 shows another variation of the opening 136. An opening 138 according to this variation is a through-hole whose front end portion is partially open frontward. That is, the opening 138 is a cutout formed by cutting off a portion of the nip plate 130.

Further, instead of the periphery 136A of the opening 136 of the embodiment, the nip plate 130 may be processed, by embossing, for example, such that the nip plate 130 is formed with a plurality of protrusions as the engaging portion. In this case, each of the plurality of protrusions protrudes toward the backup roller 140 and surrounds the protruding portion 164.

Further, according to the stay 160 of the embodiment, the tip end 162A of each first hook portion 162 and the tip end 163A of the second hook portion 163 are all designed to protrude leftward (oriented toward a single direction). However, the tip end 163A of the second hook portion 163 may extend frontward instead of leftward, while the tip ends 162A of the first hook portions 162 extend leftward as in the embodiment. In other words, the direction in which the first hook portions 162 extend may be different from the direction in which the second hook portion 163 extends.

Further, in the present embodiment, the protruding portion 164 is formed on the stay 160, while the opening 136 engageable with the protruding portion 164 is formed on the nip plate 130. However, the nip plate 130 may be formed with a protrusion (engaging portion), while the stay 160 may be formed with a hole (engaged portion) that is engaged with the protrusion. In the latter case as well, the nip plate 130 assembled to the stay 160 is restricted from moving in a direction (front-to-rear direction as well as left-to-right direction or axial direction) perpendicular to the direction in which the nip plate 130 and the backup roller 140 confront each other (top-to-bottom), since the protrusion is engaged with the hole.

Further, in the depicted embodiment, the fusing belt 110 is employed as a tubular member. This fusing belt 110 may be a resin belt or a metal belt. Alternatively, the tubular member may be a belt whose outer circumferential surface is coated with an elastic layer, such as a rubber, or may be formed of a tubular-shaped elastic member, such as rubber.

In the depicted embodiment, the backup roller 140 is employed as a backup member. However, a belt like pressure member is also available.

Further, the sheet S can be an OHP sheet instead of a plain paper and a postcard.

Further, in the depicted embodiment, the present invention is applied to the monochromatic laser printer 1 as an example of an image forming apparatus. However, a color laser printer, an LED printer, a copying machine, and a multifunction device are also available.

While the invention has been described in detail with reference to the embodiments thereof, it would be apparent to those skilled in the art that various changes and modifications may be made therein without departing from the spirit of the invention.

What is claimed is:

1. A fixing device comprising:

an endless belt having an inner peripheral surface defining an internal space;

a backup member;

a heater elongated in a longitudinal direction inside the internal space of the endless belt;

a nip plate elongated in the longitudinal direction inside the internal space of the endless belt, the nip plate and the backup member being configured to nip the endless belt therebetween, the nip plate being formed with a through-hole;

a frame elongated in the longitudinal direction inside the internal space of the endless belt and configured to support the nip plate, the frame being recessed in a direction away from the heater to form a first recess; and a reflection member disposed between the frame and the heater and elongated in the longitudinal direction inside the internal space of the endless belt, the reflection member being recessed in a direction away from the heater to form a second recess in which at least a portion of the heater is disposed, the reflection member being configured to reflect radiant heat from the heater, wherein the frame is provided with a protruding portion protruding in a direction toward the backup member, the protruding portion having a portion disposed within the through-hole of the nip plate.

2. The fixing device as claimed in claim 1, wherein the nip plate has a surface in which the through-hole is defined, and wherein the protruding portion is engaged with the surface of the nip plate.

3. The fixing device as claimed in claim 1, wherein the nip plate has a surface in which the through-hole is defined, and wherein the protruding portion is in contact with the surface of the nip plate.

4. The fixing device as claimed in claim 1, wherein the protruding portion protrudes in a protruding direction, the protruding portion having a tip end that slopes relative to a direction perpendicular to the protruding direction.

5. The fixing device as claimed in claim 1, wherein the frame has a supporting surface in contact with the nip plate, the protruding portion protruding from the supporting surface.

6. The fixing device as claimed in claim 5, wherein the nip plate comprises a first surface configured to contact the inner peripheral surface of the endless belt and a second surface opposite to the first surface, and wherein the supporting surface of the frame is in contact with the second surface of the nip plate.

7. The fixing device as claimed in claim 6, wherein the backup member and the nip plate form a nip therebetween where a sheet is to be conveyed in a conveying direction at the nip, and wherein the through-hole of the nip plate is positioned upstream relative to the nip in the conveying direction.

8. The fixing device as claimed in claim 7, wherein the protruding portion of the frame is positioned upstream relative to the nip in the conveying direction.

9. The fixing device as claimed in claim 7, wherein the frame is configured to urge the nip plate toward the backup member.

10. The fixing device as claimed in claim 1, wherein the frame comprises a metal frame.

11. The fixing device as claimed in claim 1, wherein the frame comprises a stay.

12. The fixing device as claimed in claim 1, wherein the frame is recessed in the direction away from the heater such that the frame has a substantially U-shape when viewed in the longitudinal direction of the heater, and wherein the reflection member is recessed in the direction away from the heater such that the reflection member has a substantially U-shape when viewed in the longitudinal direction of the heater.

13. The fixing device as claimed in claim 1, wherein the frame has a base portion, the protruding portion protruding from the base portion and having a tip end, the base portion and the tip end of the protruding portion being positioned at sides opposite to each other with respect to the through-hole of the nip plate.

14. The fixing device as claimed in claim 1, wherein the protruding portion includes a portion directly facing the endless belt.

15. A fixing device comprising:

an endless belt having an inner peripheral surface defining an internal space;

a heater elongated in a longitudinal direction inside the internal space of the endless belt;

a roller;

a nip plate elongated in the longitudinal direction inside the internal space of the endless belt, the nip plate and the roller being configured to nip the endless belt therebetween, the nip plate being formed with a through-hole;

a frame elongated in the longitudinal direction inside the internal space of the endless belt and configured to support the nip plate, the frame being recessed in a direction away from the heater to form a first recess; and a reflection member disposed between the frame and the heater and elongated in the longitudinal direction inside the internal space of the endless belt, the reflection member being recessed in a direction away from the heater to form a second recess, the reflection member being configured to reflect radiant heat from the heater, wherein the frame has a base portion and a protruding portion protruding from the base portion, the protruding portion extending through the through-hole of the nip plate, and wherein the protruding portion has a tip end, the base portion and the tip end of the protruding portion being positioned at sides opposite to each other with respect to the through-hole of the nip plate.

16. The fixing device as claimed in claim 15, wherein the frame is configured to urge the nip plate toward the roller.

17. A fixing device comprising:

an endless member having an inner peripheral surface defining an internal space;

a heater elongated in a longitudinal direction inside the internal space of the endless member;

a backup member;

a nip member elongated in the longitudinal direction inside the internal space of the endless member, the nip member and the backup member being configured to nip the endless member therebetween, the nip member being formed with a through-hole;

a supporting member elongated in the longitudinal direction inside the internal space of the endless member and configured to support the nip member; and a reflection member disposed between the supporting member and the heater and elongated in the longitudinal direction inside the internal space of the endless member, the reflection member being configured to reflect radiant heat from the heater, wherein the supporting member has a base portion and a protruding portion protruding from the base portion in a direction toward the backup member, the protruding portion extending through the through-hole of the nip member to be exposed to the endless member.

18. The fixing device as claimed in claim 17, wherein the supporting member is recessed in a direction away from the heater to form a recess, and wherein the through-hole of the nip member and the protruding portion of the supporting member are disposed outside of the recess.

19. The fixing device as claimed in claim 18, wherein the protruding portion has a tip end, the base portion and the tip end of the protruding portion being positioned at sides opposite to each other with respect to the through-hole of the nip member.

20. The fixing device as claimed in claim 17, wherein the endless member comprises an endless belt, wherein the backup member comprises a roller, and wherein the nip member comprises a nip plate.

21. The fixing device as claimed in claim 17, wherein the protruding portion has a tip end, the base portion and the tip end of the protruding portion being positioned at sides opposite to each other with respect to the through-hole of the nip member.

* * * * *